United States Patent [19]

Klatt et al.

[11] 4,369,696

[45] Jan. 25, 1983

[54] ELECTRO-PNEUMATIC CONTROL VALVE FOR PNEUMATIC DOOR ACTUATOR

[75] Inventors: Alfred Klatt, Wathlingen; Günther Singbartl, Hanover, both of Fed. Rep. of Germany

[73] Assignee: WABCO Fahrzeugbremsen GmbH, Hanover, Fed. Rep. of Germany

[21] Appl. No.: 225,077

[22] Filed: Jan. 14, 1981

[30] Foreign Application Priority Data

Feb. 20, 1980 [DE] Fed. Rep. of Germany ..... 3006259

[51] Int. Cl.[3] ..... F15B 13/04; F15B 11/08

[52] U.S. Cl. ..... 91/465; 137/596.17; 137/625.65

[58] Field of Search ..... 137/596.17, 625.64, 137/625.65; 251/65; 91/459, 465; 361/181, 210; 381/167

[56] References Cited

U.S. PATENT DOCUMENTS

| | | | |
|---|---|---|---|
| 2,409,517 | 10/1946 | Schmit | 91/465 |
| 2,476,519 | 7/1949 | Van Der Werff | 137/596.17 |
| 2,633,871 | 4/1953 | Parsons | 137/596.17 |
| 2,799,293 | 7/1957 | Clay | 137/596.17 |
| 3,212,751 | 10/1965 | Hassa | 251/65 |

*Primary Examiner*—Martin P. Schwadron
*Assistant Examiner*—Richard L. Klein
*Attorney, Agent, or Firm*—G. J. Falce

[57] ABSTRACT

A vehicle door control valve device having a pair of two-way, electro-magnetically operated, pneumatic valve members arranged so that one valve member is operated to a first position, in which compressed air is supplied to one side of a pneumatic actuator that operates the door, while concurrently, a second identical valve member is operated to an opposite position, in which compressed air is exhausted from the other side of the pneumatic door actuator. The relative positions of the respective valve members may be alternately switched to effect door opening and closing. Operation of the valve members is electro-magnetically controlled by primary and secondary coils arranged to cooperate with a permanent magnet, so that only momentary energization of the coils is necessary to effect switching of the valve members. The arrangement is such that in the case of an emergency, opposite sides of the pneumatic door actuator are both de-pressurized to permit manual door operation.

5 Claims, 4 Drawing Figures

ELECTRO-PNEUMATIC CONTROL VALVE FOR PNEUMATIC DOOR ACTUATOR

BACKGROUND OF THE INVENTION

The present invention is related to door control apparatus for passenger carrying vehicles and particularly to such apparatus employing pneumatic door actuators and two-way control valves for supplying and releasing pneumatic pressure at the opposite sides of the pneumatic actuator piston.

Typically, these two-way control valves are solenoid operated, one valve supplying pressure to one side of the actuator piston, while another valve exhausts pressure from the opposite side of the actuator piston. Consequently, one or the other of these solenoid operated control valves is energized while the door is open, and the other is energized while the door is closed. Because the door is either open or closed, it should be apparent that the solenoid windings must operate for an extended duration and therefore must be designed for a 100% duty factor, which results in high costs. In addition, the passenger safety factor dictates that the control valves be capable of exhausting both sides of the pneumatic actuator piston simultaneously in order to allow the door to be manually operated, in the event a passenger or other obstacle becomes lodged in the doorway.

It is known in the prior art to actuate a solenoid valve by a momentary electrical impulse and to maintain the valve in the actuated position by a permanent magnet.

SUMMARY OF THE INVENTION

The object of the present invention is to provide a pair of two-way, solenoid operated pneumatic valves of the impulse type arranged so that when one valve opens, the other closes and vice-versa.

A further object of the invention is to arrange the solenoid operated pneumatic valves so that in an emergency, both sides of the pneumatic actuator piston may be depressurized to permit manual operation of the vehicle door.

In meeting the above objectives, there is provided in a common housing a pair of two-way, solenoid operated pneumatic valves, each having a first position in which a supply valve is closed and an exhaust valve is opened. A primary coil for each valve is arranged so that upon energization, the respective valve is moved from its first position to a second position in which the valving is reversed. A permanent magnet is effective to maintain the valve in this second position following de-energization of the primary coil, so as to require only momentary energization to effect valve reversal. A secondary coil is arranged to counteract the holding effect of the permanent magnet when momentarily energized, in order to allow a return spring to move the valve to its first position.

The foregoing arrangement lends itself to a control arrangement in which the primary coil of one valve is energized simultaneously with de-energization of the secondary coil of the other valve, and vice-versa. In this manner, the delivery lines to opposite sides of a pneumatic actuator may be alternately pressurized and depressurized to effect opening and closing of the vehicle door, without requiring continuous energization of the respective valve solenoids.

Moreover, the arrangement further lends itself to momentary energization of the secondary coils of each solenoid operated valve, so as to cause each valve to assume its first position in which the respective sides of the pneumatic actuator are both exhausted, in order to permit manual operation of the door, in the event of an emergency such as a passenger or other obstacle being stuck in the doorway to prevent proper door operation.

BRIEF DESCRIPTION OF THE DRAWINGS

Other objectives and advantages of the invention will become apparent from the following detailed description and operation, when taken with the accompanying drawings in which.

Figure 1:
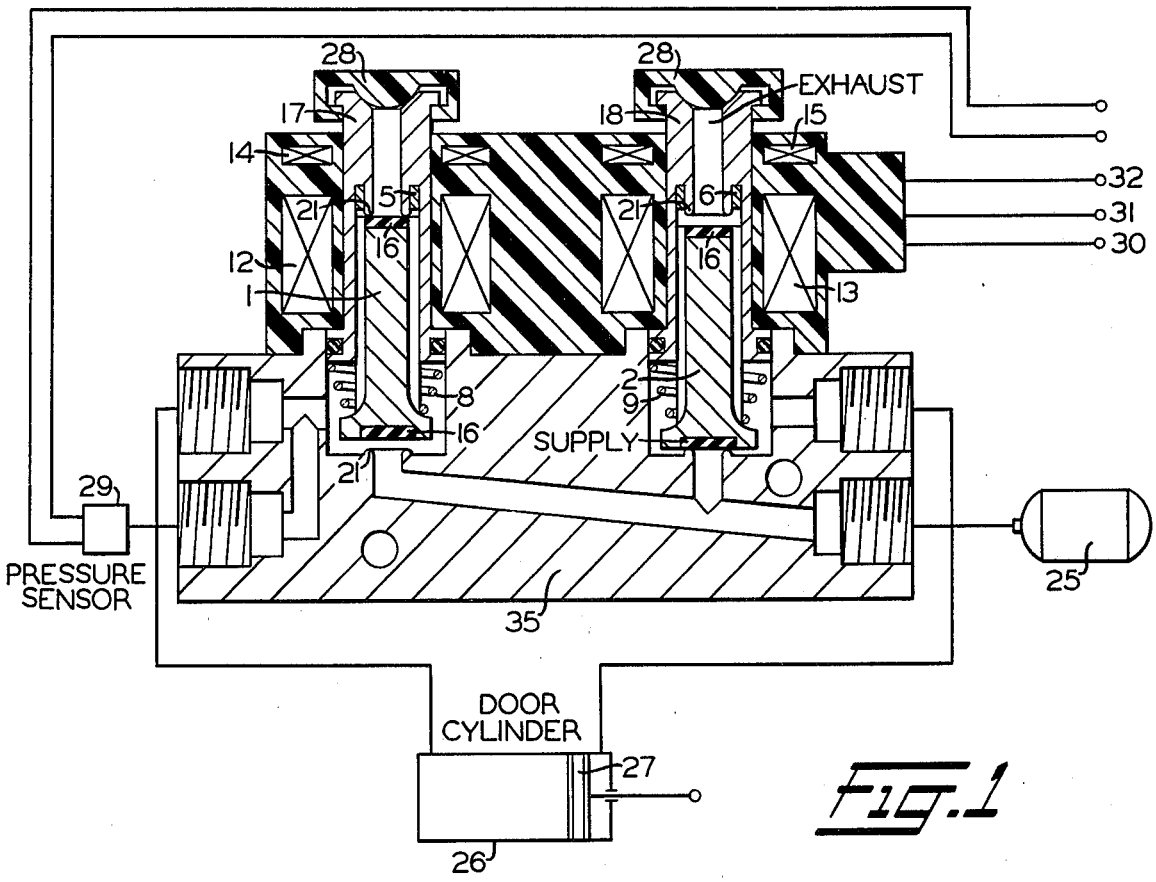
FIG. 1 is a schematic of a control valve device of the present invention.

The valve device of FIG. 1 comprises a pair of identical solenoid operated, two-way valves having active valve members 1 and 2. Each active valve member is provided with a sealing element 16 at its opposite ends for engagement with a supply valve seat 21 at one end and an exhaust valve seat 21 at the other end of cylindrical cartridges 17 and 18 in which valve members 1 and 2 are carried.

The valve device comprising valves 1 and 2 controls the supply of compressed air from a storage reservoir 25 to one or the other ends of a pneumatic door actuator 26, while exhausting compressed air previously supplied to the opposite end. As shown, valve member 1 is in its upper position and valve member 2 is in its lower position. Compressed air stored in reservoir 25 is thus connected via the open supply valve 21 of valve member 1 to the chamber at the left of the door actuator piston 27, to urge movement of piston 27 in a rightward direction. In order to accommodate this rightward movement of actuator piston 27, the chamber on the right-hand side of piston 27 is vented via the unseated exhaust valve 21 of valve member 2. When the position of valve members 1 and 2 is reversed, pressure is supplied to the right-hand side of actuator piston 27 and vented from the left-hand side to effect movement of actuator 26 in the opposite direction. A pressure switch 29 subject to supply pressure at one or the other valve member senses pressurization of a selected side of actuator 26 to provide an indication of door opening or closing, as desired.

Operation of valve members 1 and 2 will now be explained. Valve member 1 is held in its upper position, as shown, by a permanent magnet 5 in proximity therewith and having a magnetic force of attraction therewith acting in opposition to a return spring 8. In order to obtain maximum holding force, valve member 1 is made out of a ferromagnetic material. A primary coil 12, as well as a secondary coil 14 are also provided for a purpose, as now explained. In order to shift valve member 1 to its lower position, a current impulse is supplied to secondary coil 14, which is polarized in such a way as to momentarily counteract the magnetic effect of permanent magnet 5, thus allowing spring 8 to become effective to shift valve member 1 to its lower position into seating engagement with supply valve 21.

In the case of valve member 2, momentary energization of coil 13 overcomes the effect of spring 9 to force the valve member to its upper position into engagement with exhaust valve seat 21. In this position, valve member 2 is in such proximity of permanent magnet 6 as to be held in this position by the constant magnetic field of the permanent magnet following disappearance of the energizing impulse at coil 13 and remains in this position until secondary coil 15 is impulsed.

Figure 2:
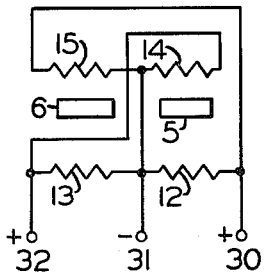
FIG. 2 is a wiring diagram showing a proposed arrangement for connecting the primary and secondary coils of the respective solenoid valves.

In order to control the simultaneous switching of valve members 1 and 2, it will be apparent that the primary coil of one valve member and the secondary coil of the other valve member must be energized at the same time. Shown in FIG. 2 is a control circuit to simultaneously reverse the position of valve members 1 and 2, in order to operate actuator 26, so as to either open or close a vehicle door, as desired. Coils 13 and 14 are connected so as to be energized by a current impulse applied at terminal 32 and connected to ground terminal 31 via coils 13 and 14 in parallel. Energization of primary coil 13 raises valve member 2 to its upper position in which it is maintained by permanent magnet 6, while energization of secondary coil 14 counteracts permanent magnet 5 to allow return spring 8 to pull valve member 1 to its lower position. This results in the positions of valve members 1 and 2 being reversed from the position shown in FIG. 1 and thereby reversing the position of door actuator 26.

Alternatively, coils 12 and 15 are arranged to be energized simultaneously by a current impulse applied at terminal 30 and connected to ground terminal 31 via coils 12 and 15 in parallel. This action restores valve members 1 and 2 to their respective positions, as shown in FIG. 1.

Figure 3:
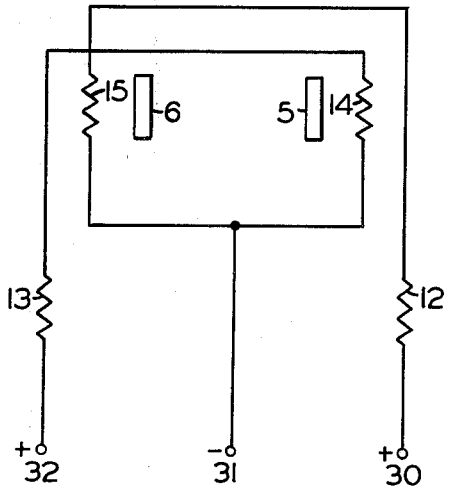
FIG. 3 is a wiring diagram showing an alternative arrangement to FIG. 2.

The control circuit arrangement of FIG. 3 differs from that of FIG. 2 only in that the primary and secondary coils of the different valve members 1 and 2 are connected in series rather than in parallel.

Figure 4:
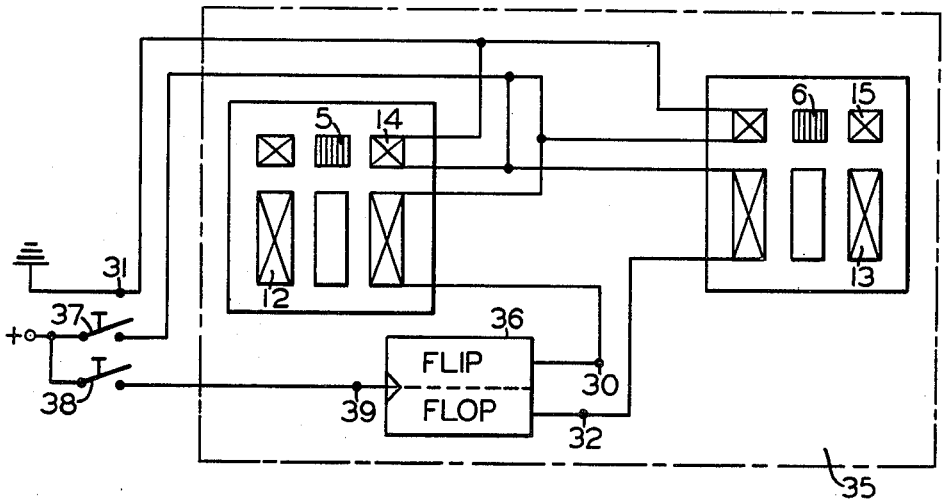
FIG. 4 is an expanded wiring diagram of the solenoid valve primary and secondary coils arranged to permit emergency manual operation of the door.

FIG. 4 represents a further improvement of the arrangement of FIG. 3, by the addition of a switching device 36, which is designed so that its input 39 can alternately be connected to the respective outputs to which terminals 30, 32 are connected. This switching device may be a flip-flop, relay, or pressure switch. To operate the door actuator, only a single switch 38 need be momentarily actuated to pulse the appropriate pair of primary and secondary coils 12, 15 or 13, 14.

A second switch 37 may be operated independently of switch 38 to concurrently energize the secondary coil 14, 15 of the respective valve members 1 and 2. In this way, the holding effect of magnets 5, 6 is nullified and both valve members are spring operated to their lower position, thereby de-pressurizing both sides of the door actuator piston 27 to permit manual operation of the door in the event of an emergency.

Having now described the invention, what we claim as new and desire to secure by Letters Patent, is:

1. A control valve device for a pneumatic actuator comprising:

(a) an inlet to which a source of compressed air is connected;

(b) first and second outlets connected respectively to the opposite sides of said pneumatic actuator;

(c) a first two-way valve member having a first position in which compressed air is connected from said inlet to said first outlet and having a second position in which compressed air is exhausted from said first outlet;

(d) a second two-way valve member having a first position in which compressed air is connected from said inlet to said second outlet, and having a second position in which compressed air is exhausted from said second outlet;

(e) each said first and second valve member comprising:

(i) a spring acting on said respective valve member to urge movement thereof toward a first position;

(ii) a primary coil having an electro-magnetic force when energized to urge said respective valve member toward a second position in opposition to said spring;

(iii) a permanent magnet arranged in such proximity of said respective valve member in said second position thereof as to magnetically atract and thereby maintain said respective valve member in said second position following de-energization of said primary coil; and (iv) a secondary coil arranged to magnetically counteract said permanent magnet when energized; and (f) said primary and secondary coils of said first and second valve members being connected to one another so that a momentary impulse of electric current thereto causes said primary coil of one valve member and secondary coil of the second valve member to be simultaneously energized, whereby one of said valve members is operated to said first position and the other of said valve members is operated to said second position.

2. A control valve device as recited in claim 1, further characterized in that said secondary coils of said first and second valve members are connected to one another so as to be concurrently energized independently of said primary coils, whereby said first and second valve members are both forced to said second positions thereof.

3. A control valve device as recited in claim 1 further comprising:

(a) a control switch;

(b) bistable switch means for connecting said impulse of current to said primary and secondary coils of said first and said second valve members alternatively in response to momentary operation of said control switch.

4. A control valve device as recited in claim 2 further comprising:

(a) a control switch;

(b) bistable switch means for connecting said impulse of current to said primary and secondary coils of said first and said second valve members alternatively in response to momentary operation of a said control switch.

5. A valve device as recited in claim 2 or 4, further comprising an emergency switch via which said secondary coils of said first and second valve members are concurrently energized.

* * * * *